US008471493B2

(12) United States Patent
Yem et al.

(10) Patent No.: US 8,471,493 B2
(45) Date of Patent: Jun. 25, 2013

(54) COMBINATION LED DRIVER

(75) Inventors: Poh Weng Yem, Pulau Pinang (MY); Keng Yeam Chang, Pulau Pinang (MY); Lee Ling Teh, Bukit Mertajam (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 252 days.

(21) Appl. No.: 13/093,592

(22) Filed: Apr. 25, 2011

(65) Prior Publication Data

US 2012/0268032 A1 Oct. 25, 2012

(51) Int. Cl.
*H05B 37/02* (2006.01)
*H05B 39/00* (2006.01)

(52) U.S. Cl.
USPC ..... 315/291; 315/312; 315/307

(58) Field of Classification Search
USPC ..... 315/291, 294, 297, 307, 312
See application file for complete search history.

(56) References Cited

U.S. PATENT DOCUMENTS

| | | | | |
|---|---|---|---|---|
| 7,456,586 | B2 * | 11/2008 | Morejon | 315/247 |
| 7,518,319 | B2 * | 4/2009 | Konno et al. | 315/291 |
| 7,696,703 | B2 * | 4/2010 | Lin | 315/291 |
| 7,843,148 | B2 * | 11/2010 | Gater et al. | 315/291 |
| 7,872,621 | B2 | 1/2011 | Lee | |
| 7,902,762 | B2 * | 3/2011 | Chen | 315/209 R |
| 8,044,609 | B2 * | 10/2011 | Liu | 315/291 |
| 2010/0327770 | A1 | 12/2010 | Pados et al. | |

FOREIGN PATENT DOCUMENTS

| | | | |
|---|---|---|---|
| CN | 201267030 | Y | 7/2009 |
| JP | 62099166 | A | 5/1987 |

OTHER PUBLICATIONS

Brown et al., "Development of a Tunable LED-Based Colorimetric Source", Journal of Research of the National Institute of Standards and Technology, vol. 107, No. 4, Jul.-Aug. 2002, 9 pages.

* cited by examiner

*Primary Examiner* — Don Le

(57) ABSTRACT

A driver circuit for a Light Emitting Diode (LED) is disclosed. The driver circuit is capable of supporting a constant LED current circuit configuration as well as an external resistor-controlled LED current circuit configuration. By integrating both configurations into a single driver circuit, the either circuit configuration can be selected without requiring a different driver circuit.

20 Claims, 4 Drawing Sheets

COMBINATION LED DRIVER

FIELD OF THE DISCLOSURE

The present disclosure is generally directed toward circuit arrangements for controlling diodes and particularly toward circuit arrangements for controlling light emitting diodes.

BACKGROUND

Light Emitting Diodes (LEDs) have many advantages over conventional light sources, such as incandescent, halogen and fluorescent lamps. These advantages include longer operating life, lower power consumption, and smaller size. Consequently, conventional light sources are increasingly being replaced with LEDs in traditional lighting applications. As an example, LEDs are currently being used in flashlights, camera flashes, traffic signal lights, automotive taillights and display devices.

There are two main types of circuit arrangements currently used to control/drive LEDs. A first circuit arrangement is a driver circuit which provides constant current to the LED. A second circuit arrangement is a driver circuit which relies on an external resistor to control current to the LED.

Drivers which employ the constant LED current approach are typically based on constant current circuitry in an Integrated Circuit (IC) to determine the amount of LED current flowing through the LED. On the other hand, drivers which employ the external resistor controlled approach require an additional resistor be connected in series with the LED and the resistance of the resistor controls the amount of current which flows through the LED. There are several disadvantages to using either circuit arrangement.

Problems associated with employing the constant LED current approach include: (1) circuit size increases with the increment of LED current selection; (2) higher headroom (or output voltage) is required unless a larger transistor is provided; and (3) there are eye safety issues at low supply levels.

Problems associated with employing the external resistor controlled approach include: (1) a large variation of LED current; (2) extra resistor represents an additional cost; and (3) power saving mode is not available (e.g., it is not possible to switch to lower LED current at brighter surfaces).

BRIEF DESCRIPTION OF THE DRAWINGS

The present disclosure is described in conjunction with the appended figures.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Figure 1B:
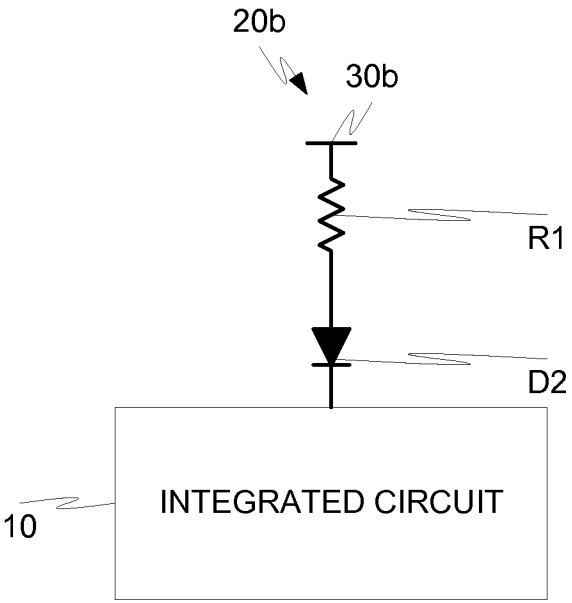
FIG. 1B depicts a second circuit arrangement with a diode in accordance with embodiments of the present disclosure.
Figure 1A:
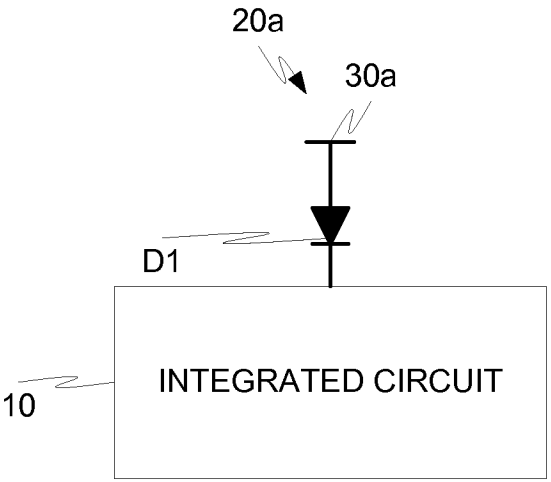
FIG. 1A depicts a first circuit arrangement with a diode in accordance with embodiments of the present disclosure.

FIGS. 1A and 1B depict two different circuit arrangements which can be supported by an IC 10 designed in accordance with embodiments of the present disclosure. As will be discussed in further detail below, an IC 10 may be configured with a combination driver/controller circuit configured to accommodate either a first circuit arrangement 20*a* or a second circuit arrangement 20*b* at a common input of the IC 10.

In some embodiments, the first circuit arrangment 20*a* comprises a first current supply 30*a* which provides current through a first diode D1. The first diode D1, in some embodiments, may comprise an LED or collection of LEDs (e.g., two or more LEDs connected in series to one another). Those of ordinary skill in the art will also appreciate that the first diode D1 may be replaced with a plurality of diodes that are connected in parallel and/or series with one another.

In some embodiments, the second circuit arrangement 20*b* comprises a second current supply 30*b* which provides current through a first resistor R1 and a second diode D2. The first resistor R1, in some embodiments, may be referred to as an external resistor and the resistance of the first resistor R1 may be used to control the amount of current which flows through the second diode D2. In other embodiments, where the second circuit arrangement 20*b* is controlled using a constant LED current approach, the first resistor R1 may be provided to avoid eye safety issues that arise at high supply levels rather than to control the current flowing through the second diode D2. It should be appreciated that the first resistor R1 may be a single resistor or a collection of resistors which are connected in parallel and/or series with one another. Similar to the first diode D1, the second diode D2 may correspond to a single LED or collection of LEDs.

The first circuit arrangement 20*a* represents the type of LED circuit arrangement which may be controlled by a constant LED current approach. The second circuit arrangement 20*b* represents the type of LED circuit arrangement which may be controlled by an external resistor controlled approach, hence the need for the first resistor R1 or alternatively the second circuit arrangement 20*b* may be controlled by a "constant LED current approach" and the first resistor R1 helps to neutralize eye safety issues associated with operating the second diode D2 at high supply levels.

As discussed herein, the first circuit arrangement 20*a* does not comprise an external resistor connected in series with the first diode D1 (neglecting inherent resistance in electrical connections, leads, and the like). In other words, the first resistor R1 represents an actual resistor (or collection of resistors) placed in series with the second diode D2 and is more than inherent resistance created in the circuit by physical connections and conduits. Accordingly, statements that the first circuit arrangement 20*a* does not include a resistance and the second circuit arrangement 20*b* does include an external resistance intentionally ignore the fact that all circuits inherently have some amount of resistance. The term "resistor" is intended to include discrete electronic resistors and the like.

It should be appreciated that the current supplies 30*a*, 30*b* may be connected to other circuitry or components. The current supplies 30*a*, 30*b* may include any type of known devices suitable for providing current through the diodes D1, D2 sufficient to place the diodes D1, D2 in an active state (e.g., cause the diodes D1, D2 to emit light when the diodes D1, D2 correspond to LEDs). The current from the current supplies 30*a*, 30*b* may be configured to flow through the diodes D1, D2 into the IC 10.

The IC 10 may be provided with internal circuitry which enables the IC 10 to control the current flowing through the diodes D1, D2. Advantageously, the IC 10 may be designed to accommodate either the first circuit arrangement 20*a* or the second circuit arrangement 20*b* without requiring a modification of the components within the IC 10.

Figure 2:
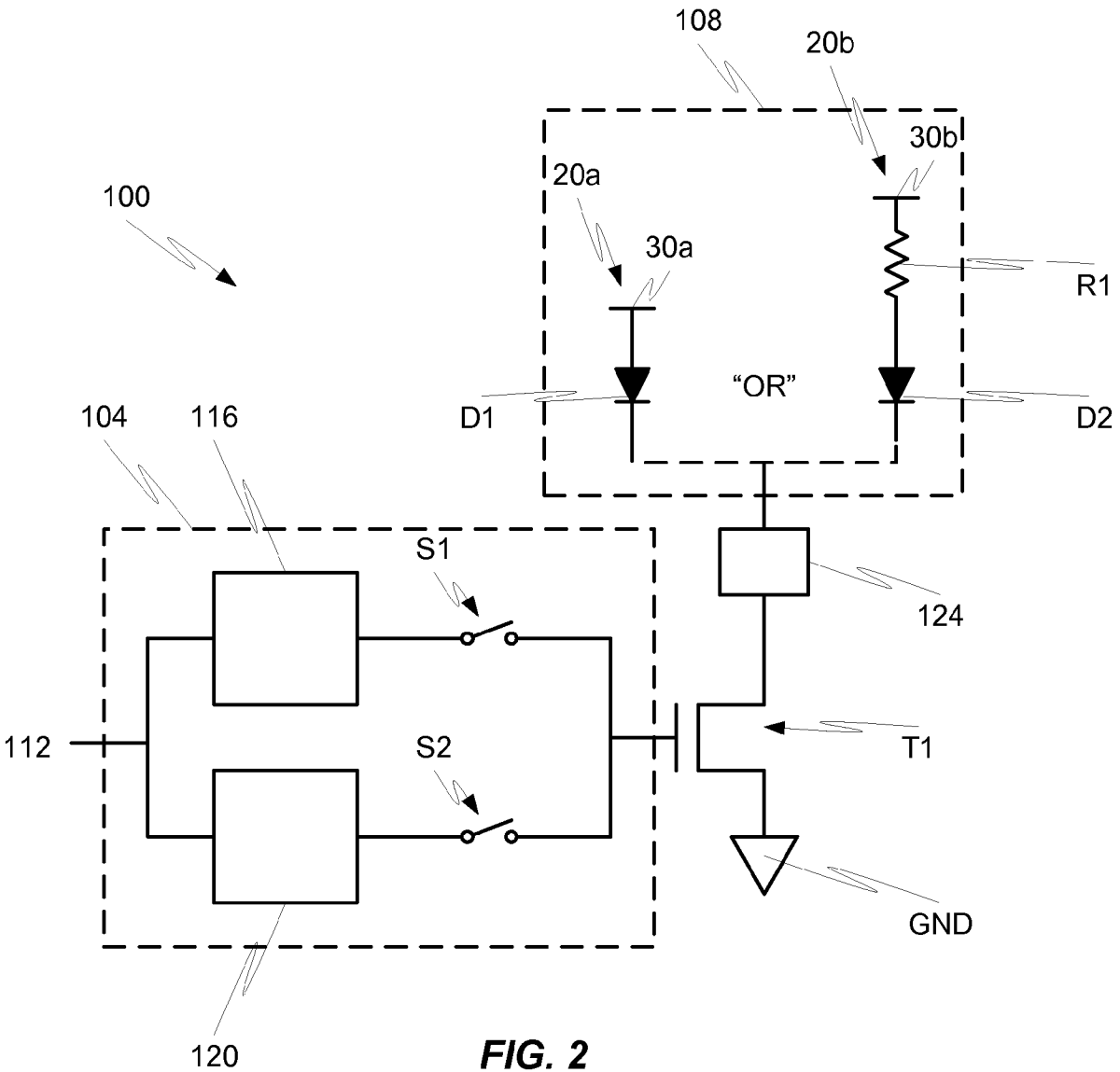
FIG. 2 depicts details of a first diode driver arrangement in accordance with embodiments of the present disclosure.

With reference now to FIG. 2, details of a first diode driver circuit arrangement 100 will be described in accordance with at least some embodiments of the present disclosure. In some embodiments, the first diode driver circuit arrangement 100 comprises a transistor T1. One lead/terminal of the transistor T1 may be connected to an IC input 124 (e.g., an IC pin or lead). Another lead/terminal of the transistor T1 may be connected to a transistor input circuit 104. Another lead/terminal of the transistor T1 may be connected to ground GND, an equivalent thereof, or some other electrical node.

In some embodiments, the transistor T1 may correspond to an N-channel MOSFET or NMOS. The transistor T1 may be relatively large in size (e.g., 0.8 um×20 um×200). As can be appreciated, P-channel MOSFETs or other types of transistors may be utilized for the transistor T1. The specific configuration and type of transistor used does not necessarily have to be limited to the examples discussed herein. Moreover, the transistor T1 may either be a single transistor or a collection of transistors which are connected in parallel and/or series with one another.

In some embodiments, the transistor input circuit 104 is used to control operation of the transistor T1. In particular, the transistor input circuit 104 may provide an electrical control signal to the gate of the transistor T1. Depending upon the control signal applied by the transistor input circuit 104, the operation of the diode (e.g., D1 or D2) connected to the transistor T1 can be controlled. In particular, if a first control signal is provided as an input to the transistor T1 by the transistor input circuit 104, current may be allowed to flow through the diode D1 or D2, thereby causing the diode to be in an operable state (e.g., causing the diode to emit light if the diode is an LED). Conversely, if a second control signal (different from the first control signal) is provided as an input to the transistor T1 by the transistor input circuit 104, current may be restricted from flowing through the diode D1 or D2, thereby causing the diode to be in an inoperable state (e.g., causing the diode to stop emitting light if the diode is an LED).

In accordance with at least some embodiments of the present disclosure, the transistor T1 and transistor input circuit 104 may be included as components of the IC 10. The composition of the transistor input circuit 104 enables the IC input 124 to be connected to an IC input circuit 108 which comprises either the first circuit arrangement 20*a* or the second circuit arrangement 20*b*. Specifically, the transistor input circuit 104 may be configured to switch between a first and second operational state, where one operational state (e.g., a constant LED current control state) supports connection of the first circuit arrangement 20*a* to the IC input 124 whereas another operational state (e.g., an external resistor controlled control state) supports connection of the second circuit arrangement 20*b* to the IC input 124. In some embodiments, the second circuit arrangement 20*b* can be operated by the IC 10 when the transistor input circuit 104 is in either operational state, but the first circuit arrangement 20*a* can only be operated by the IC 10 when the transistor input circuit 104 is in one of the operational states (e.g., the constant LED current control state).

In some embodiments, the transistor input circuit 104 may comprise a common control input signal 112 which is fed to the transistor T1 either by circuitry 116 or by circuitry 120. Circuitry 116 may be used to control either the first circuit arrangement 20*a* or the second circuit arrangement 20*b* whereas circuitry 120 may only be used to control the second circuit arrangement 20*b*. One or more switches S1, S2 may be provided in the transistor input circuit 104 to control whether the common control input signal 112 flows through circuitry 116 or circuitry 120.

In some embodiments, the first operational state of the transistor input circuit 104 may correspond to a configuration where the first switch S1 is closed and the second switch S2 is opened and the common control input signal 112 travels through circuitry 116 to transistor T1. In this operational state, the first circuit arrangement 20*a* or second circuit arrangement 20*b* may be connected to the IC input 124.

In some embodiments, the second operational state of the transistor input circuit 104 may correspond to a configuration where the first switch Si is opened and the second switch S2 is closed and the common control input signal 112 tranvels through circuitry 120 to transistor T1. In this operational state, the second circuit arrangement 20*b* may be connected to the IC input 124.

In some embodiments, the first switch Si may only be closed if the second switch S2 is opened and vice versa. In some embodiments, the switches S1, S2 can be implemented as transmission gates. Operation of the switches S1, S2 may be achieved either electrically or mechanically.

With the first diode driver circuit arrangement 100 depicted in FIG. 2, only one transistor T1 is needed and by controlling the switches S1, S2, either a constant LED current-based LED driver (e.g., first operational state of transistor input circuit 104) or an external resistor controlled-based LED driver (e.g., second operational state of transistor input circuit 104) can be selected. When an external resistor controlled-based LED driver is selected, the constant LED current-based LED driver can be turned off to avoid power dissipation.

Advantageously, ICs 10 employing the first driver circuit arrangement 100 and designed in accordance with embodiments of the present disclosure can be sold to customers who want to implement the first circuit arrangement 20*a* as well as customers who want to implement the second circuit arrangement 20*b*. Alternatively, or in addition, ICs 10 designed in accordance with embodiments of the present disclosure can be sold to customers who want to have the option of implementing the first and/or second circuit arrangement 20*a*, 20*b* without requiring different ICs for each arrangement. This helps reduce transaction costs as well as minimize design costs.

Figure 3:
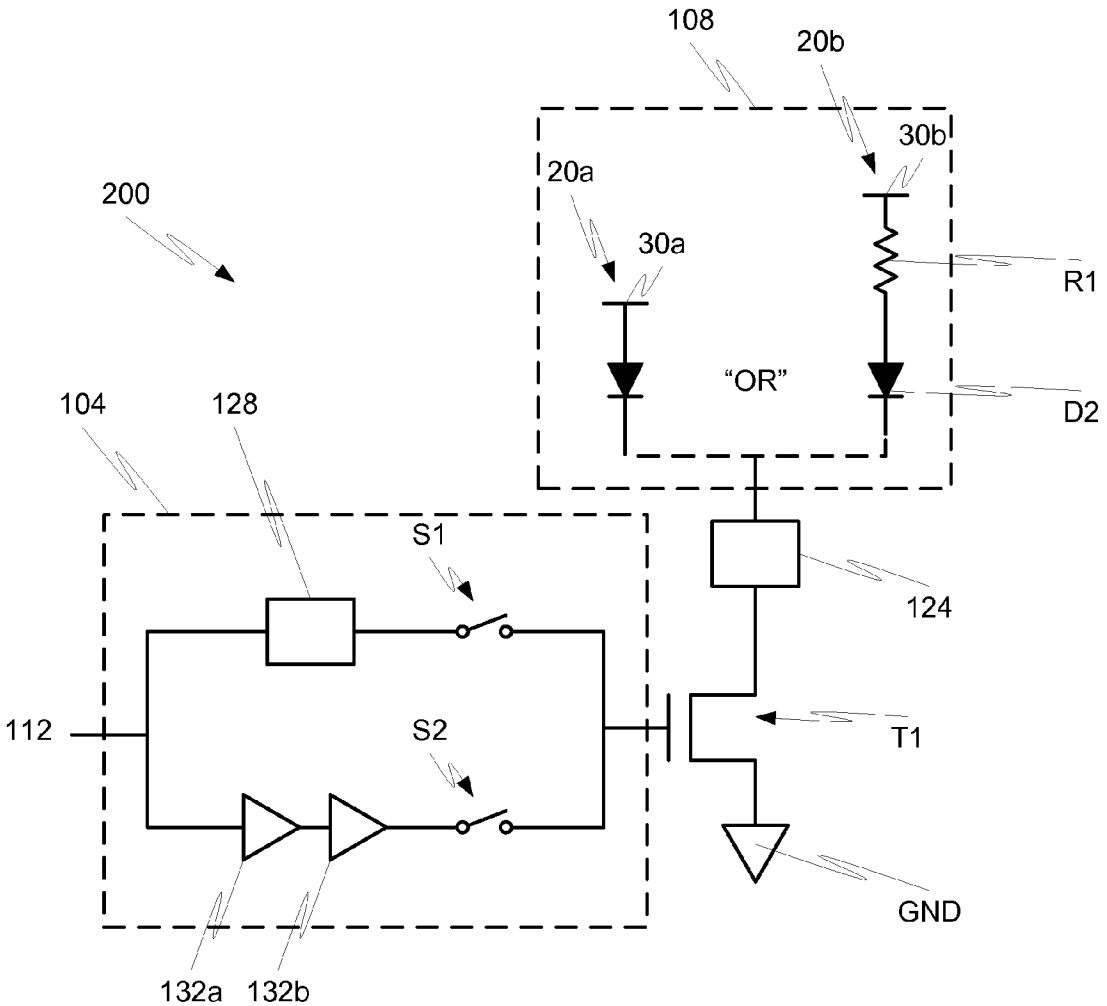
FIG. 3 depicts details of a second diode driver arrangement in accordance with embodiments of the present disclosure.

With reference now to FIG. 3, a second diode driver circuit arrangement 200 will be described in accordance with embodiments of the present disclosure. In some embodiments, the second diode driver circuit arrangement 200 is similar or identical to the first diode driver circuit arrangement 100 except additional details of circuitry 116, 120 are depicted in FIG. 3. It should be appreciated, however, that the configuration of circuitry 116, 120 should not be limited to the examples depicted in FIG. 3. Rather, FIG. 3 is only intended to depict one possible configuration of circuitry 116, 120.

In some embodiments, circuitry 116 may comprise current control circuitry 128. The current control circuitry 128 may comprise a plurality of transistors, logic gates (e.g., AND and/or OR gates), switches, resistors, inductors, capacitors, and any other type of digital control circuitry that can be included in IC 10. The current control circuitry 128 may be used to sense the amount of current flowing through the first diode D1 or second diode D2 and in response to sensing such current, adjust the amount of current allowed to flow through the first diode D1 or second diode D2.

In some embodiments, circuitry 120 may comprise one or more inverters 132*a*, 132*b*. The inverters 132*a*, 132*b* may be configured to drive the transistor T1 by conditioning the common control input signal 112 provided to the gate of the transistor T1. When the inverters 132*a*, 132*b* are connected to the transistor T1, however, the current flowing through diode D2 is limited by the first resistor R1.

Figure 4:
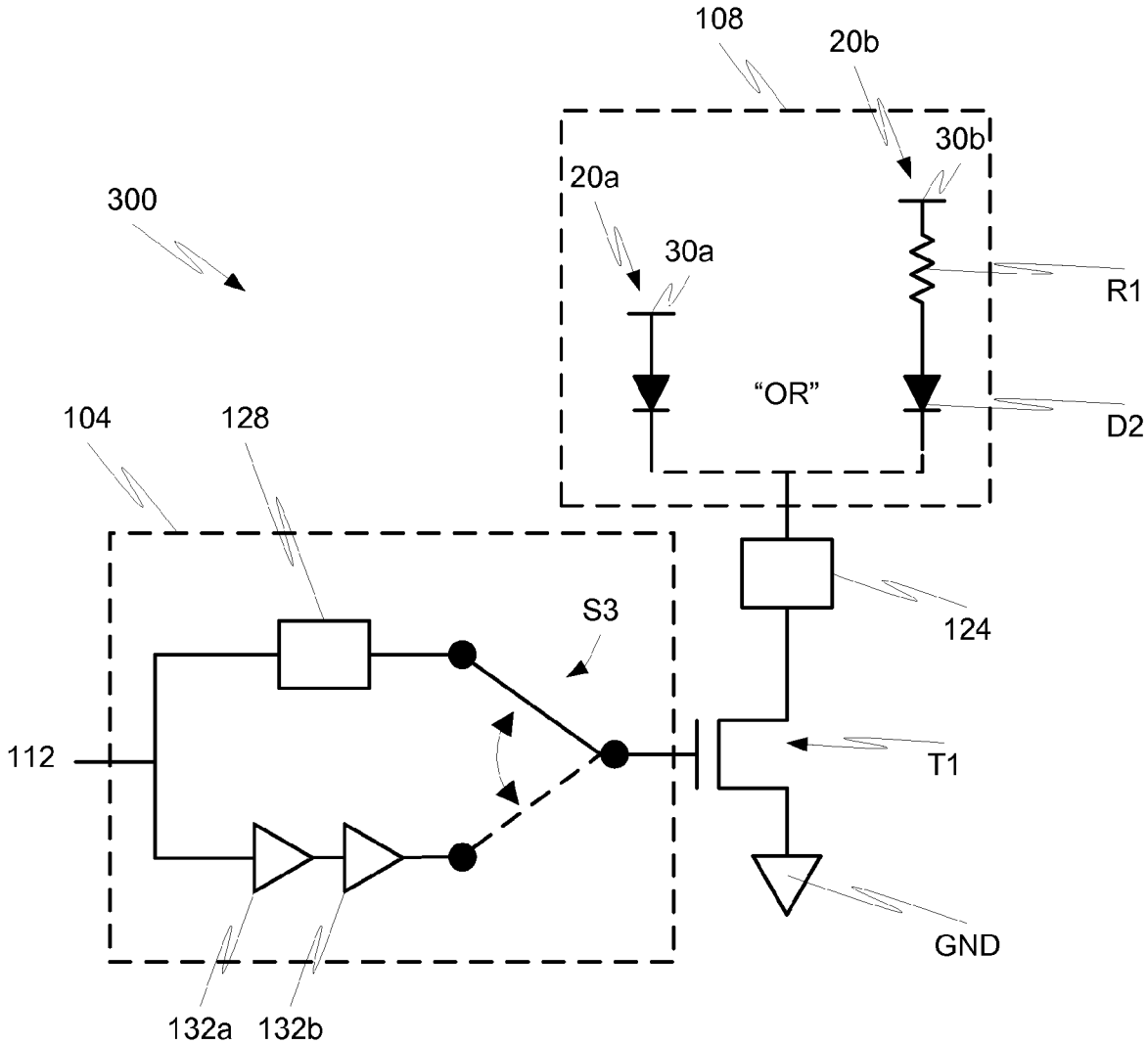
FIG. 4 depicts details of a third diode driver arrangement in accordance with embodiments of the present disclosure.

Referring now to FIG. 4, a third diode driver circuit arrangement 300 will be described in accordance with at least some embodiments of the present disclosure. The third diode driver circuit arrangement 300 presents an alternative configuration of the transistor input circuit 104. The transistor input circuit 104 comprises a single switch S3 rather than a pair of switches S1, S2. In this configuration, the switch S3 can be moved between a first and second position. In a first position, the circuitry 116 (e.g., current control circuitry 128) is connected to the transistor T1. In a second position, the circuitry 120 (e.g., inverters 132*a*, 132*b*) is connected to the transistor T1.

There are a number of advantages associated with using any one of the diode driver circuit arrangements described herein. First, by integrating both circuitry 116 and 120 into one transistor input circuit 104, the customer (e.g., purchaser of an IC 10) will have choices to select either a constant LED current approach or an external resistor controlled approach depending upon which will suit their application the best.

A second advantage is that if the current selection of the constant LED current-based LED driver does not cater for the preferred LED current, the customer can switch to external resistor controlled-based LED driver to accommodate any amount of LED current can be set through the resistance of the external resistor R1.

A third advantage is for the applications at low supply level, the customer can choose an external resistor controlled-based LED driver as lower headroom is required.

A fourth advantage is that for the application at low supply level, eye safety issue can be solved by using an external resistor controlled-based LED driver.

A fifth advantage is that for applications where precise LED current is needed, the customer can choose a constant LED current-based LED driver with the same IC 10 that was purchased for an external resistor controlled-based LED driver.

A sixth advantage is that the external resistor R1 might not be needed with constant LED current-based LED driver, thereby saving money.

A seventh advantage is that power savings can be achieved with a constant LED current-based LED driver (e.g., switch to lower LED current at brighter surface).

An eighth advantage is that the IC 10 developer can convert their existing constant LED current-based LED driver to a "combo LED driver" at almost no die size increment as the control circuits used in external resistor controlled are usually constructed by inverters 132*a*, 132*b*, which are small in size, thereby adding value at minimal extra cost.

Specific details were given in the description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. A circuit arrangement for controlling current flowing through an LED, the circuit arrangement comprising:

a transistor comprising first, second, and third terminals, the first terminal of the transistor being configured to be electrically connected to the LED; and a transistor input circuit configured to receive a control signal and being connected to the second terminal of the transistor, the transistor input circuit comprising first circuitry configured to control current flowing through an LED via the transistor with or without a resistor connected in series with the LED, second circuitry configured to control current flowing through an LED via the transistor only with a resistor connected in series with the LED, and at least one switch configured to control whether the first circuitry or second circuitry carries the control signal to the second terminal of the transistor.

2. The circuit arrangement of claim 1, wherein the first terminal comprises a transistor drain, wherein the second terminal comprises a transistor gate, and wherein the third terminal comprises a transistor source.

3. The circuit arrangement of claim 2, wherein the transistor source is connected to ground.

4. The circuit arrangement of claim 1, wherein the transistor comprises an NMOS.

5. The circuit arrangement of claim 1, wherein the first circuitry comprises current control circuitry, wherein the second circuitry comprises one or more inverters, and wherein the transistor comprises a plurality of transistors.

6. The circuit arrangement of claim 5, wherein the at least one switch comprises one or more transmission gates.

7. The circuit arrangement of claim 1, wherein the first terminal is connected to an IC input.

8. An Integrated Circuit comprising the circuit arrangement of claim 1.

9. An Integrated Circuit comprising a transistor input circuit enabling the Integrated Circuit to drive a first LED circuit arrangement when the transistor input circuit is in a first operational state as well as drive a second LED circuit arrangement when the transistor input circuit is in a second operational state, wherein the first LED circuit arrangement comprises an LED without an external resistance connected in series therewith, and wherein the second LED circuit arrangement comprises an LED with an external resistance connected in series therewith.

10. The Integrated Circuit of claim 9, wherein the external resistance connected in series with the LED in the second LED circuit arrangement controls the amount of current which flows through the LED.

11. The Integrated Circuit of claim 9, wherein a common control input is used by the transistor input circuit in both the first and second operational states.

12. The Integrated Circuit of claim 11, further comprising one or more switches which switch whether the transistor input circuit is in the first or second operational state.

13. The Integrated Circuit of claim 12, wherein the one or more switches comprise one or more transmission gates.

14. The Integrated Circuit of claim 13, wherein the Integrated Circuit also drives the second LED circuit arrangement in the second operational state.

15. The Integrated Circuit of claim 12, wherein the transistor comprises a gate, drain, and source terminal.

16. The Integrated Circuit of claim 15, further comprising an input pin that is connected to the transistor drain.

17. A transistor input circuit connected to a transistor, the transistor input circuit configured to control current flowing through a diode via the transistor, the transistor input circuit comprising:

first circuitry configured to control current flowing through the diode with or without a resistor connected in series with the diode;

second circuitry configured to control current flowing through the diode only with a resistor connected in series with the diode; and a switch configured to control whether the first circuitry or second circuitry is electrically connected to the transistor.

18. The circuit of claim 17, wherein the first and second circuitry are connected in parallel.

19. The circuit of claim 17, wherein the first circuitry comprises current control circuitry, wherein the second circuitry comprises one or more inverters, and wherein the switch comprises a transmission gate.

20. The circuit of claim 17, wherein the diode comprises an LED.

* * * * *